US009290979B1

(12) United States Patent
Alexander et al.

(10) Patent No.: US 9,290,979 B1
(45) Date of Patent: Mar. 22, 2016

(54) ADJUSTABLE PANEL CLOSURE BUMPERS INCORPORATING SHAPE MEMORY POLYMERS

(71) Applicants: GM GLOBAL TECHNOLOGY OPERATIONS LLC, Detroit, MI (US); THE REGENTS OF THE UNIVERSITY OF MICHIGAN, Ann Arbor, MI (US)

(72) Inventors: Paul W. Alexander, Ypsilanti, MI (US); Jonathan E. Luntz, Ann Arbor, MI (US); Alan W. Moyer, Clinton Township, MI (US); Diann Brei, Milford, MI (US); Suhant Ranga, Ann Arbor, MI (US); Nancy L. Johnson, Northville, MI (US)

(73) Assignees: GM Global Technology Operations LLC, Detroit, MI (US); The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 14/487,185

(22) Filed: Sep. 16, 2014

(51) Int. Cl.
*E05F 5/02* (2006.01)

(52) U.S. Cl.
CPC ..... *E05F 5/022* (2013.01)

(58) Field of Classification Search
CPC ..... E05F 5/022; E05F 5/025
USPC ..... 296/207
See application file for complete search history.

(56) References Cited

U.S. PATENT DOCUMENTS

| | | | | |
|---|---|---|---|---|
| 5,482,348 | A * | 1/1996 | Mass et al. | 296/207 |
| 7,690,722 | B2 * | 4/2010 | Boggess | 296/207 |
| 8,991,537 | B2 * | 3/2015 | Snede et al. | 180/69.2 |
| 2008/0217941 | A1 * | 9/2008 | Chernoff et al. | 296/1.02 |
| 2009/0108607 | A1 * | 4/2009 | Browne et al. | 296/1.02 |
| 2012/0246896 | A1 * | 10/2012 | Kaji et al. | 24/682.1 |
| 2013/0219658 | A1 * | 8/2013 | Krajewski et al. | 16/82 |
| 2014/0147656 | A1 * | 5/2014 | Browne et al. | 428/313.9 |
| 2014/0305725 | A1 * | 10/2014 | Snede et al. | 180/69.2 |

* cited by examiner

*Primary Examiner* — Jason S Morrow
(74) *Attorney, Agent, or Firm* — Reising Ethington P.C.

(57) ABSTRACT

An adjustable bumper, adapted for supporting closure panels on a vehicle, is described. The bumper incorporates a shape memory polymer portion, which may be readily permanently reshaped by the steps of: heating above its transition temperature, deforming by application of a load, and cooling, while still under load, below its transition temperature. This behavior is exploited to enable adjustment of the adjustable bumper so that it may provide the desired closure panel support while accommodating vehicle to vehicle variations in the fit of the closure panel and the vehicle body.

19 Claims, 4 Drawing Sheets

ADJUSTABLE PANEL CLOSURE BUMPERS INCORPORATING SHAPE MEMORY POLYMERS

TECHNICAL FIELD

This invention pertains to self-adjusting panel closure bumpers, passive supports for vehicle sheet metal closure panels, and methods of use.

BACKGROUND OF THE INVENTION

In discussion of motor vehicle construction, a distinction is commonly made between the frame structure of the vehicle body, in which sheet metal components are welded or bolted together and maintained in fixed and permanent relation to one another, and closure panels which are designed and intended to open and close to permit access to the interior of the frame structure. Examples of such closure panels include doors, hoods, hatches, and decklids, each of which is commonly attached to the body via spaced apart hinges at, or near, one edge and straddling a panel centerline. Closure panels also commonly incorporate a locking and latching mechanism, mounted on or near the edge of the closure panel opposite the hinges, and usually positioned on the same panel centerline.

Each closure panel typically comprises two attached sheet metal stampings. The first stamping, usually called an outer panel is viewable by an external observer. The second stamping usually called an inner panel is normally hidden from view. The inner and outer panels may be attached at both their edges and interior locations, such as hoods and decklids, or secured only at their edges with a hollow space between inner and outer panels to accommodate, for example, a window and its operating mechanism, or a loudspeaker, or various electrical or electronic switches and controls. Commonly such construction is found in doors and hatches.

Closure panels are intended to fit centrally within a corresponding opening within the vehicle body so that a uniform and consistent gap is maintained between the edge of the closure and the body opening. The positioning of the closure panels within the body opening is established by the cooperative interaction of the hinges and the locking structure. These also contribute to ensuring that the panel is maintained at its correct elevation relative to the adjacent panels so that there is continuity of line between the body and the closure panel without dips, rises, and/or tilts which would be displeasing to an observer. Supplementary supports to control closure panel elevation are often used. These supports, more properly called panel closure bumpers, or simply, bumpers are typically, but not necessarily, mounted to the vehicle body, and extend outwardly from the body a suitable distance to contact and support the closure panel.

In addition, the bumpers serve to control flex, vibration, and noise which may occur during closing of the panel. In closing, such panels are commonly rotated under acceleration to ensure full engagement of the lock with the locking mechanism. This sudden deceleration which results when locking occurs can lead to vibration and unacceptable noise. The addition of properly-positioned bumpers is effective in suppressing such noise and in modifying its frequency to render a more customer-pleasing tone. However if the bumpers are set too 'high', that is they would enforce a greater than desired closure panel and body separation, the closure closing effort will be increased. Alternatively, if the bumpers are set too low they will not contact and support the closure panel and will be ineffective. Thus accurate setting of the bumper height is required for their proper functioning.

However, because every vehicle is built to tolerances, vehicle-to-vehicle variations in the fit of body panels will occur during vehicle assembly in a manufacturing plant. Thus the bumpers must be adjustable and incorporate at least the capability of compensating for, and accommodating, the expected vehicle build variation to assure the appropriate placement of the closure panel to achieve smooth vehicle lines and customer-pleasing closing tones in the assembled vehicle. Adjustment of such bumpers is often accomplished using trial and error and may require appreciable time and effort to achieve a desired build quality.

Once the bumpers are adjusted at the manufacturing plant to achieve proper placement, the need for further adjustment is minimal, but in-service adjustment may be required if either the body or the closure panel is repaired or replaced.

There is thus a need for an adjustable bumper which may be more quickly and easily adjusted, especially during vehicle assembly.

SUMMARY OF THE INVENTION

As shown in the simplified partial view of a front portion of an automobile 100 at FIG. 1, an exemplary closure panel, a hood 110, is shaped, in outline, to fit between the fenders 120, the cowl 130 and the front fascia and grille 140 of an automobile. Those of skill in the art will appreciate that a typical hood will comprise an inner sheet metal panel attached to an outer sheet metal panel and may incorporate hemmed edges or downstanding edge flanges, as well as various aesthetically-pleasing and panel-stiffening features. For simplicity, none of these features are illustrated in this view, and the hood is shown simply as a single sheet metal component. The hood is hingeably attached to the body by hinges 150. Most closure panels are four-sided with the general form of a trapezoid. Commonly, the hinges 150 are mounted, spaced-apart, at or near one side or edge of the hood. Centrally mounted at, or near, the opposing edge of the hood is a latch 160 for engagement with a vehicle body-mounted lock 162. The remaining two edges 114, 116 of the hood are typically free of hardware. Because the hood panel may flex, the three-point support afforded by the hinges 150 and latch/lock combination 160/162 may be insufficient to maintain the closure panel in its intended position and provide continuity of line between the closure panel and the abutting panels. Thus, supplementary supports called panel closure bumpers, or bumpers, are typically used. As shown at FIG. 1 these bumpers 113, often have the form of a threaded upright post capped with a resilient, often elastomeric material, and are mounted on the vehicle body. By rotating the threaded post the bumpers may be adjusted to a suitable length or height so that the elastomeric portion contacts the underside of the closed hood 110 at designated locations 112. Spaced-apart bumpers 113, are supported near the fascia 140 on body portion 117 and located where they can provide additional support to the latch-mounted edge of the hood through contact with the underside surface 111 of hood 110 at locations 112. Often, locations 112 may be contoured or shaped to provide a suitable bumper-contacting surface. Commonly, such bumpers may be positioned far outboard of the latch and proximate to the two opposing hood edges 114, 116 of the closure.

While bumpers are almost always found in the locations shown, there has been an increasing trend to provide additional bumpers, both to further support the latch-mounted edge of the hood, and also to better support opposed edges 114, 116. Thus, a plurality of supplementary bumpers may be attached to body portion 117 or its continuation 117'. During vehicle assembly, bumpers 113 are adjusted to appropriately locate the hood 110 in the body opening. Further adjustment in the course of normal vehicle service is usually unnecessary but may be required if, during service, the hood or its surrounding body portion is repaired or replaced. Such adjustment may require extensive trial and error to suitably position all the bumpers and the task will become increasingly burdensome as greater numbers of bumpers are used.

This disclosure pertains to adjustable bumpers for supporting and positioning closure panels on vehicles. The adjustable bumpers include a mounting portion comprising a mounting member or a mounting structure for attachment of the bumper to the vehicle body or to the closure panel. The mounting portion is attached to a mutually-centered material stack comprising at least a somewhat compliant, resilient body, often an elastomer, and a suitably shaped shape memory polymer (SMP) portion. The stack has a central longitudinal axis for receiving a load. Without limitation to their shape and design, and by way of illustration only, such bumpers may, in one embodiment be generally round or rectangular in cross-section with a diameter or side dimension of about 20 millimeters or so and extend outwardly from the body or closure by about 15 to 25 millimeters. The bumpers are mounted with their load-receiving central longitudinal axis generally perpendicular to the closing direction of the closure so that, when closed, the closure exerts a modest compressive force to the stack along the longitudinal axis of the stack.

SMPs are one of a group of "smart" materials, that is, designed materials with properties which may be controllably modified when exposed to an external stimulus. The property change may be abrupt and repeatable and such materials are increasingly being considered for automotive applications. Generally, SMPs may be phase segregated co-polymers comprising at least two different molecular segments within the SMP. The behaviors of each segment may be modified, commonly but not exclusively, by change of temperature, so that an SMP will exhibit a transition temperature demarking the influences of its various constituent segments. One segment is commonly considered to be a 'hard' segment and the other the 'soft' segment, with each segment contributing differently to the overall properties of the SMP in different temperature regimes.

When the SMP is heated above the transition temperature, the SMP will become appreciably more compliant, by up to a factor of 200 or so, and may be readily shaped into a desired configuration. The shape change may be made permanent by subsequently cooling the SMP below the transition temperature.

In an embodiment, a self-adjusting bumper comprises a relatively stiff elastomeric, closure-contacting portion, supported, in stacked configuration, on a quantity of SMP of suitable shape and configuration to form a short pillar or post and further comprising a body-engaging mount to secure the bumper to the vehicle body. In a second embodiment a relatively stiff elastomeric portion may support a stacked SMP portion, again in a pillar-like or post-like configuration. In this embodiment, because of the limited shock resistance of the SMP portion at in-service or ambient temperature, or about 25° C., the SMC portion may be 'capped' by a thin sheet of a compliant elastomer to diminish the shock of initial contact with the closure panel during closing. An exemplary SMP portion may be an unfilled, pore-free block, but bumpers may also accommodate SMP in other geometric shapes as well as be adapted to use filled and porous SMP formulations.

During installation and adjustment of the bumper, for example during vehicle assembly, at least the SMP portion of the bumper is heated to a temperature greater than its transition temperature and sufficient to render the SMP readily deformable. The bumper is affixed and secured to the vehicle body with the closure, for example the hood of FIG. 1, in its opened position. The closure is then closed and brought to its intended predetermined position, compressing and reshaping the SMP portion while maintaining the elastomeric portion in engagement with the closure inner panel. The closure is then locked in engagement with the body locking mechanism, or maintained in its intended position with a jig or fixture, so that the SMP portion is maintained in its compressed configuration and in forcible engagement with the inner closure panel. The closure panel is maintained in its locked position until the SMP cools below its transition temperature to thereby 'lock in' the deformed shape of the SMP and to assure that the elastomeric portion is appropriately positioned to forcibly contact and support the closure panel during subsequent closing events.

Under the most extreme conditions, vehicle components are expected to range in temperature from about 70° C. to 95° C., depending on their location on the vehicle. The transition temperature of the SMP portion should be chosen to be greater than the maximum expected in-service temperature to ensure that it remains in its low-compliance state during service and so undergoes no unintentional reshaping. Thus, the SMP portion may be formed of any suitable composition with a transition temperature of greater than about 70° C.-95° C., depending on location, to ensure that even on the hottest day, the SMP will not be exposed to temperatures greater than its transition temperature. Suitable compositions, among others, may include polymer components such as, polyphosphazenes, poly(vinyl alcohols), polyamides, polyimides, polyester amides, poly(amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof.

The SMP portion may be homogeneous, porous, with open or closed pores, filled with powder or fibrous fillers, or any combination of these. Any fillers may be thermally and/or electrically conductive. The SMP portion may incorporate channels or passages for passage or temporary storage of heated air or fluids to facilitate heating to above its transition temperature The SMP portion may be in the form of a block, optionally partially laterally restrained within a polymeric or metallic sheath, and may be parallel-sided or tapered. Such a tapered configuration may be effective in the first embodiment of the device, enabling a wider body-mountable SMP base tapering to a reduced section to support the elastomeric portion. The SMP portion may also be shaped into various geometric forms with inherent geometrical compliances such as a helix or a bent beam.

The elastomeric portion may be a polyurethane elastomer or EPDM rubber (ethylene propylene diene monomer (M-class) rubber), a synthetic rubber and elastomer, suitably with a durometer of between 50 and 100, more preferably between 60 and 80. The contacting surface of the bumper may be smooth or have a texture such as, without limitation, bumps, ridges, or fingers to improve contact with the mating surface. The elastomeric portion should forcibly engage the mating surface to eliminate any momentary separation of the mating surface and the bumper under modest vibratory loading. Any such separation will produce noise due to the repeated separation and re-engagement of the bumper and mating surface. The polymeric portion composition is selected to avoid marring of the mating surface during contact and, further, to have a sufficient mechanical integrity so that polymer particles are not deposited on the mating surface when the closure is opened.

The body-engaging feature may include: a screw, for engagement with a body-mounted bolt; a bolt, for engagement with a body-mounted screw; a tabbed plate incorporating a plurality of tabs for tabular engagement with a like plurality of openings in a body member; any of a number of polymer-based push-in attachments such as Christmas Tree Clips, Stalok™ Fasteners (produced by ITW Fastex) and similar designs well known to those of skill in the art for engagement with suitable body openings; and a sheet metal support adapted for attachment to the body by welding or through the use of mechanical fasteners. The bumper may also be attached to the body with adhesive, for example, by the use of a double-sided adhesive tape.

Although it is feasible to adjust the bumpers after a vehicle is placed in service, it is anticipated that bumper adjustment will predominantly take place during vehicle assembly and build a manufacturing plant. During vehicle assembly it is anticipated that heating of the SMP would most commonly be conducted off-line, for example by heating under one or more infra-red (IR) lamps, or by placement in an oven or a heated fluid bath. However, heating in situ or after mounting of the bumper to the vehicle body using, for example, heat guns, or heaters with cavities, sized and adapted to accommodate the bumper, is also contemplated. If the SMP portions incorporate electrically-conductive fillers, the bumpers might be heated in situ by passage of electric current through the filler material. Of course, such in situ approaches may readily be adapted to in service adjustment of the bumpers if required.

In all descriptions so far, the bumper has been located on the body and the elastomeric portion has been in contact with the inner panel of the closure. It will be appreciated that the configuration may be reversed, that is, the bumper may be mounted on the closure and an elastomeric portion may contact the body provided only that such mounting does not mar the appearance of the outer panel of the closure or interfere with any included mechanisms.

BRIEF DESCRIPTION OF THE DRAWINGS

In FIG. 3(*a*) the bumper, shown secured to body of a vehicle is in its original configuration at about ambient temperature. FIG. 3(*b*) shows the bumper during heating of at least its SMA portion. In FIG. 3(*c*), the bumper, with its SMP portion heated to above its transition temperature is compressed by the closing of the closure panel. The bulk of the deformation is accommodated by the SMP portion which is compressed and simultaneously expands laterally to adopt a bulged appearance. In FIG. 3(*d*), at least the SMP portion of the bumper, still compressed by contact with the closure, is cooled to reduce the temperature of the SMP portion to below its transition temperature. In FIG. 3(*e*), representing normal operation of the closure at ambient temperature, the bumper maintains its compressed shape so that it will suitably forcibly engage the closure panel when the closure is closed.

FIG. 7A depicts the bumper prior to insertion in the vehicle and prior to setting the operating bumper height. FIG. 7A shows a one-piece SMP portion comprising a base incorporating a second push-in fastener with a cantilevered, arcuate arm, partially covered by a resilient polymer layer, extending from one end of the base. The cantilevered arcuate arm terminates in a ball-like feature which lightly contacts or almost contacts the base. FIG. 7B shows the same bumper after loading by a load P sufficient to deform the bumper and reduce its height thereby displacing the ball-like feature along the base and increasing the radius of the arcuate arm.

DESCRIPTION OF PREFERRED EMBODIMENTS

Figure 1:
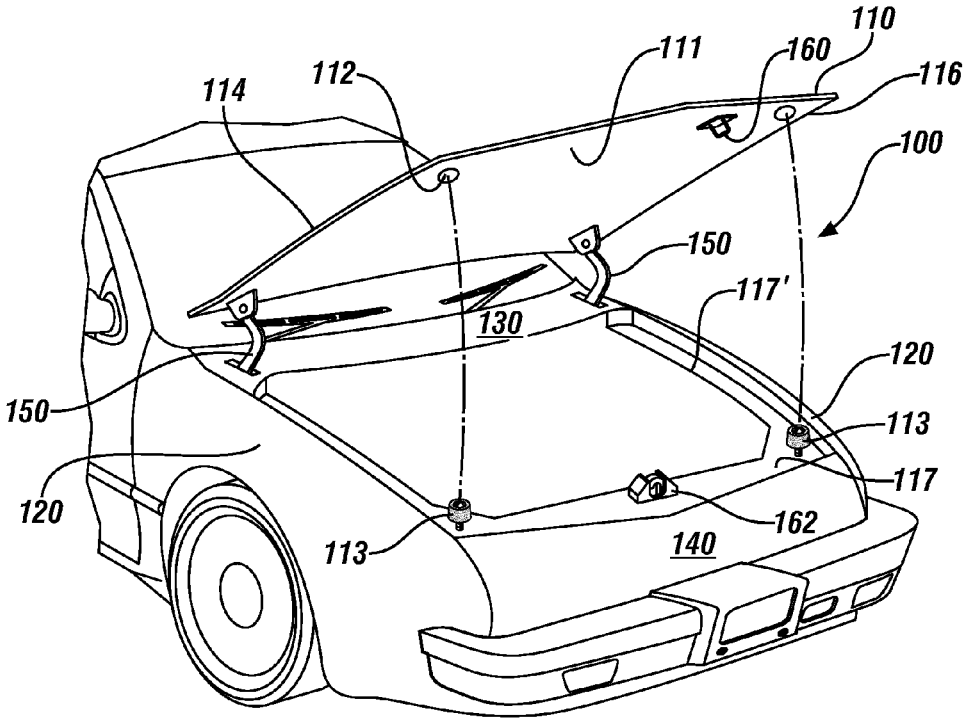
FIG. 1 shows a partial perspective view of an automobile illustrating a simplified, single layer, hood and its relationship to the vehicle body. Also shown, are the hood-mounted or body mounted hinges, latch, lock and bumpers which support and secure the hood to the body
Figure 2:
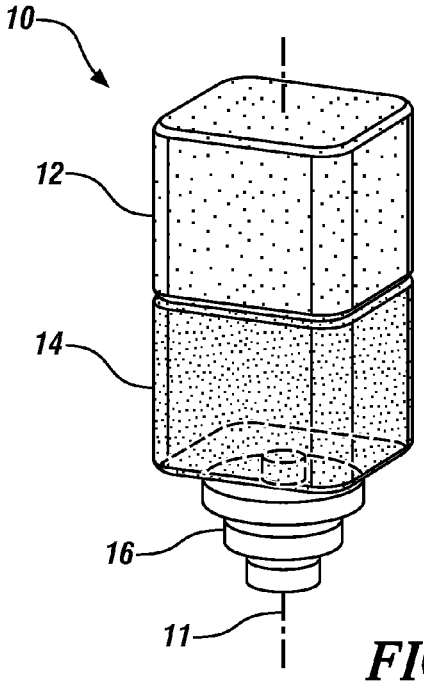
FIG. 2 shows a first embodiment of a bumper illustrating a frame attachment portion attached to a block-like SMP portion attached to a block-like resilient polymer portion.

A first embodiment of a self-adjusting panel closure bumper, or simply, bumper, 10 is shown at FIG. 2, and consists of an assembly comprising three elements or portions: a body mount portion comprising an attachment or mounting portion 16 as a base, supporting an SMP portion 14 and, stacked atop the SMP portion, a resilient, but somewhat stiff, polymeric portion 12, for example a polyurethane elastomer or EPDM (ethylene propylene diene monomer) rubber, so that the body mount portion, the SMP portion and the polymeric portion are serially arranged. As assembled, the body mount portion may be attached to the vehicle body by attachment feature 16 so that the extremity of polymeric portion 12 contacts the inner panel of the closure assembly. However, in an alternative implementation, the mounting portion may engage the inner panel of the closure so that the polymer portion is in contact with the vehicle body.

Attachment feature 16, SMP portion 14 and resilient polymeric portion 12 are permanently connected to form a single assembly. In operation, the bumper 10 is subject to compressive loads generally directed along central, longitudinal axis 11. Thus there is no need to secure the portions against tensile loads which might tend to separate the portions, and bending and shear loads are expected to be low, so that a variety of attachment methods may be used, even those which are weak in tension. These attachment methods may include adhesives, mating, mechanically-engaging features, such as dovetails, and even frictional engagement between complementary features such as a shaped post and a close fitting complementarily-shaped opening.

Due to part and build variation the separation or spacing between vehicle bodies and closure panels exhibits a range of dimensions within an allowable tolerance range. A representative tolerance range is plus/minus 3 millimeters with respect to a nominal spacing. This variation in separation or spacing should be accommodated with a single bumper style, at least for a particular closure panel. Thus, the overall bumper length should be capable of spanning the largest gap between the body and closed closure panel which falls within this allowable tolerance range while maintaining forcible contact between the closure panel and the bumper. Also, the bumper must accommodate the large reduction in length or height, and associated compressive strain, resulting when a bumper, sized overall to span the largest gap within tolerance, must be compressed to a length suitable for the smallest gap within the allowable tolerance range. This places limits on the dimensions of the SMP portion since compression occurs at a temperature greater than the SMP transition temperature and so is sustained almost entirely by the SMP portion. Thus, for the representative tolerance range of plus/minus 3 millimeters cited above, the SMP portion should sized to be capable of accommodating up to 6 millimeters of reduction in height and sustaining the resulting strain, without detriment to its in-service performance. A number of SMP compositions are capable of compression to a true strain of greater than −1, or about a 63% reduction in length or height. Accordingly a preferred bumper may be between 20 and 30 millimeters long, with a cross-sectional area of between about 150 to 750 square millimeters. The lengths of the SMP and polymer portions may, but need not necessarily be, generally equal. A ratio of SMP length to polymer length ranging between about 80:20 to 30:70 is suitable. The square cross-section shown is exemplary only and not limiting.

Figure 3:
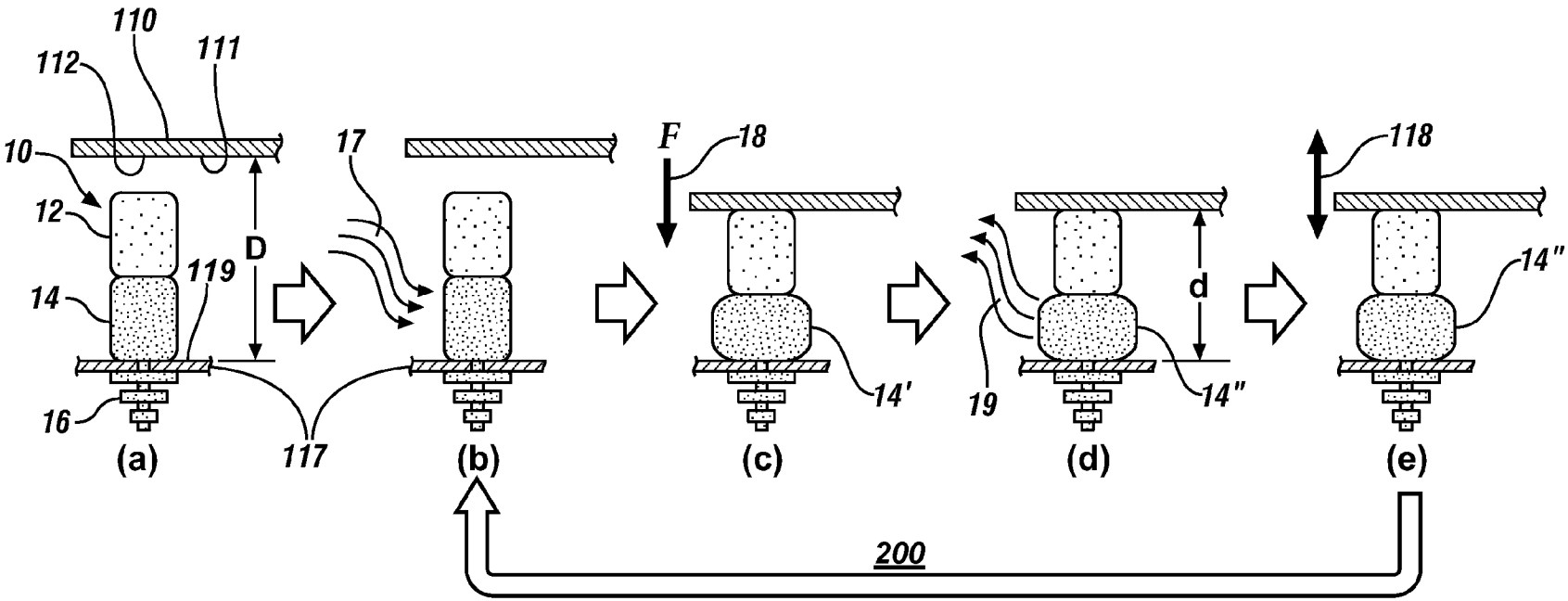
FIGS. 3 (*a*)-(*e*) show a process for setting the height of a self-adjusting bumper. The bumper shown is the first embodiment illustrated in FIG. 1, but the process is applicable to all embodiments.

Attachment feature 16 may be any suitable feature adapted to engage with either of a vehicle body or a closure panel and retain the attachment feature in a fixed location on the body or closure panel subject within the accepted tolerances of the specific attachment feature. Some exemplary attachment features, a portion of which are depicted in the alternative embodiments shown in FIGS. 4-6 and 7A-B, include threaded screws; bolts, tabbed plates, any of a number of polymer-based push-in attachments for engagement with suitable body openings, and a sheet metal support adapted for attachment to the body by welding or through the use of mechanical fasteners. Attachment feature 16 may also be co-molded with either of the SMP portion 14, as shown in FIGS. 3(*a*)-(*d*), or, in the embodiment of FIG. 4, the polymer portion 22. Of course attachment feature 16 will be selected to be compatible with complementary features on the vehicle body or closure panel which may include bolts, screws, suitably sized openings and weld pads among others.

Polymeric portion 12 may be an elastomer, for example one engineered from the polyurethane family with a durometer hardness of between 50 and 100 at ambient temperature, and, more preferably between 60 and 80. Additionally, SMP portion 14 should be formulated to resist in-service aging which might lead to embrittlement which would be problematic under the dynamic loading experienced by the bumper in service.

SMP portion 14 may exhibit a wide range of compositions, but preferably the chosen composition will be harder than polymeric portion 12 at ambient temperature and appreciably softer than the polymeric portion 12 at an elevated temperature, designated the transition temperature, as described further below.

SMPs are co-polymers which may exhibit different properties in response to some external stimulus. In most cases the temperature of the SMP is the stimulus of choice, but electromagnetic radiation-responsive and moisture-responsive SMPs are available Generally, SMPs may be phase segregated co-polymers comprising at least two different units, which may be described as defining different segments within the SMP, each segment contributing differently to the overall properties of the SMP.

The term "segment" may refer to a block, graft, or sequence of the same or similar monomer or oligomer units, which are copolymerized to form the SMP. Segments may be characterized as 'hard' or 'soft' and be crystalline or amorphous with corresponding melting points or glass transition temperatures (Tg), respectively. These segment characteristics result in a material which exhibits dramatic changes in properties under stimulus, notably changes in mechanical properties with temperature. Such materials exhibit a 'transition temperature' at which such property changes become manifest. SMPs may incorporate segments of multiple compositions and display multiple transition temperatures but, for the bumper application under consideration, two-segment SMPs with only a single hard and a single soft segment, and a single associated transition temperature, are suitable.

When the SMP is heated above its transition temperature, the SMP material can be more readily deformed than at a lower temperature and, and under application of a deformation-inducing load may readily assume a modified shape. Release of the deformation-inducing load when the SMP is above its transition temperature, will enable the SMP to revert to its undeformed shape. However, the modified shape may be retained by cooling the SMP below its transition temperature while the deformation-inducing load is applied.

The undeformed shape may be recovered by removing the deformation-inducing load and again heating the material above the transition temperature of the SMP. Thus repeating the heating, shaping, and cooling steps can repeatedly reset the deformed shape.

The transition temperature may be engineered by the choice of polymer constituents in the SMP and their proportions. Generally a range of transition temperatures of from between about 0° C. to about 300° C. are readily attainable. For the bumper application described further below, it is intended that the deformed shape of the SMP be maintained during normal vehicle service so that the SMP should be engineered to have a transition temperature greater than about 70° C. or so, and preferably greater than about 95° C. or so, since 70° C. to 95° C. is the highest temperature range normally attained by vehicle components even under extreme conditions. For ease of processing and handling of the bumper it is desirable to select an SMP composition with a transition temperature as close to the preferred range as possible. Making allowance for heat losses during processing, variability in batch to batch compositional variations, and day to day processing inconsistencies, suitable SMP compositions are preferably those with a transition temperature in the range of 70° C.-125° C. and more preferably those with a transition temperature in the range of about 95° C.-105° C.

Suitable shape memory polymers, regardless of the particular type of SMP, can be thermoplastics, thermosets-thermoplastic copolymers, interpenetrating networks, semi-interpenetrating networks, or mixed networks. The SMP "units" or "segments" can be a single polymer or a blend of polymers. The polymers can be linear or branched elastomers with side chains or dendritic structural elements. Suitable polymer components to form a shape memory polymer include, but are not limited to, polyphosphazenes, poly(vinyl alcohols), polyamides, polyimides, polyester amides, poly (amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof.

Examples of suitable polyacrylates include poly(methyl methacrylate), poly(ethyl methacrylate), poly(butyl methacrylate), poly(isobutyl methacrylate), poly(hexyl methacrylate), poly(isodecyl methacrylate), poly(lauryl methacrylate), poly(phenyl methacrylate), poly(methyl acrylate), poly(isopropyl acrylate), poly(isobutyl acrylate) and poly(octadecylacrylate). Examples of other suitable polymers include polystyrene, polypropylene, polyvinyl phenol, polyvinylpyrrolidone, chlorinated polybutylene, poly(octadecyl vinyl ether), poly (ethylene vinyl acetate), polyethylene, poly(ethylene oxide)-poly(ethylene terephthalate), polyethylene/nylon (graft copolymer), polycaprolactones-polyamide (block copolymer), poly(caprolactone) diniethacrylate-n-butyl acrylate, poly(norbornyl-polyhedral oligomeric silsequioxane), polyvinylchloride, urethane/butadiene copolymers, polyurethane-containing block copolymers, styrene-butadiene block copolymers, and the like. The polymer(s) used to form the various segments in the SMPs described above are either commercially available or can be synthesized using routine chemistry.

Particular SMP composition families (with transition temperatures in parentheses) which meet the desired range of transition temperatures include epoxies (90° C.-110° C.) and polyurethanes (95° C.-105° C.). A suitable specific formulation is a stoichiometric mixture of diglycidyl ether of bisphenol A epoxy monomer (Hexion EPON 826) and curing agent poly(propylene glycol)bis(2-aminopropyl) ether (Huntsman Jeffamine D230).

FIGS. 3(*a*)-(*e*) illustrate the process of setting or adjusting the bumper and its mode of use after setting. FIG. 3(*a*) shows the bumper 10 of FIG. 2 secured by attachment feature 16 on body feature 117 opposite closure panel 110 or some suitable portion of such a closure panel. In this configuration opposing surfaces 111 and 119 of opposing body feature 117 and closure panel portion 110 are spaced apart by a distance 'D', greater than the required panel separation 'd' (see FIG. 3(*d*)), and sufficient to maintain the extremity of polymer portion 12 out of contact with its contact location 112 on surface 111.

At FIG. 3(*b*) heat 17 is applied to at least SMP portion 14 of the bumper raising its temperature. Heating is continued until the temperature of the SMP is raised above its transition temperature, and then closure panel 110 is moved into its closed position by applying a force F in the direction of arrow 18 (FIG. 3(*c*)). Either, because only the SMP is heated while the polymeric portion remains relatively cool, or because the polymeric portion 12 is selected to be harder than the SMP portion 14 at the transition temperature, the deformation induced by the applied force occurs primarily in the SMP portion. Thus the SMP portion is compressed and laterally displaced so that it develops the 'barreled' shape 14' shown at FIG. 3(*c*). Extracting heat 19 (FIG. 3(*d*)) until the SMP cools to below its transition temperature while maintaining the applied compressive force F 'freezes in' the shape change so that re-shaped bumper 10', incorporating reshaped SMP portion 14", is effective in maintaining closure panel 110 in its intended closed position over repeated openings and closings of the closure as indicated by double arrow 118. Natural cooling, predominantly by conduction to the vehicle body and/or closure, possibly enhanced by convection, will most commonly be used. But, where access is available, natural cooling may be supplemented by application of a forced cooling airflow.

The bumper, during processing, and after achieving its intended shape will apply a reaction load to the closure due to the elasticity of both the SMP and the polymer. The reaction load due to the SMP is maintained on 'freezing in' this shape as 14" while the reaction load from the polymer will increase slightly due to the increased stiffness of the polymer at the lower operating temperature of the bumper. Such reaction load is desirable since it positively locates the closure panel and minimizes panel vibration and noise under vibratory loads.

It will be appreciates that the relative hardnesses, or compliances, of the polymeric portion 12 and SMP portion 14, at both ambient temperature and the processing temperature, will contribute significantly to the successful installation and application of the bumper. At ambient temperature, the compliance of the SMP should be less than that of the polymer, preferably by about a factor of 2 to 5 or so, to ensure that, during closure, the closure force primarily results in deflection of the polymer. Or, stated alternately, the stiffness of the SMP should be greater than that of the polymer by these factors. During installation and setting of the bumper it is intended that the deflection induced by the closure force is primarily accommodated by the SMP and the compliance of the SMP should be much greater than the compliance of the polymer, preferably by at least a factor of 5, more preferably by a factor or 10 and most preferably by a factor of 20. Expressed in terms of relative stifihesses, the stiffness of the SMP should be less than that of the polymer by these factors.

By way of example only, consider a bumper of the embodiment of FIG. 2 with initially, that is, as shown at FIG. 3(*a*), equal length portions of SMP and resilient polymer, each 10 millimeters in length and of equal cross-sectional area. During setting, as shown at FIG. 3(*c*), and assuming that the SMP is compressed 4 millimeters and is ten times more compliant than the polymer, the polymer will compress 0.4 millimeters. Thus, under load at the setting temperature, the SMP portion will be 6 millimeters in length and the polymer portion will be 9.6 millimeters in length. On cooling, and releasing the setting pressure, the SMP portion will substantially retain its compressed 6 millimeter length but the polymer portion will elastically rebound and revert to its initial length of about 10 millimeters. In service, when the closure is closed, as shown at FIG. 3(*e*), the bumper, as a whole, will be compressed by about the 0.4 millimeters deflection undergone by the polymer during setting. Assuming a compliance ratio for polymer to SMP of 3:1 at ambient temperature, the polymer will be compressed to a length of about 9.7 millimeters and the SMP will compress to a length of about 5.9 millimeters.

The shape-modified bumper 10' will retain its shape near indefinitely provided it never experiences temperatures at or above its transition temperature, so that, under normal usage, no further adjustment is required. However, if due to wear at the hinges, for example, or minor accident, or any other misadventure, the bumper no longer maintains the closure panel in its intended location, the process cycle shown at FIGS. 3(*b*)-3(*e*) may be repeated as shown at arrow 200 to reset the bumper to a new configuration which does suitably enforce the intended panel position bumper reset.

As depicted at FIGS. 3(*a*) and 3(*b*), the bumper is mounted on body feature 117 before the SMP is heated. This however is merely exemplary and it may be more convenient to heat either the SMP alone, or the entire bumper, prior to its insertion in the body panel. This may be accomplished by placing the bumper in an oven or in a heated fluid bath prior to its placement on body feature 117. Such heating bath or oven may be operated in batch or continuous mode.

Where in situ heating is required, any convenient heating method such as a hot air gun may be employed. Alternatively a hollow heater, optionally split longitudinally, and suitably customized and sized to just encompass the SMP portion could be used. If the SMP is filled with a portion of electrically-conductive powders or fibers in suitable concentration to form a continuous electrically-conductive path through the SMP, then resistance heating, effected by passage of an electrical current through the filled SMP may also be used.

Figure 4:
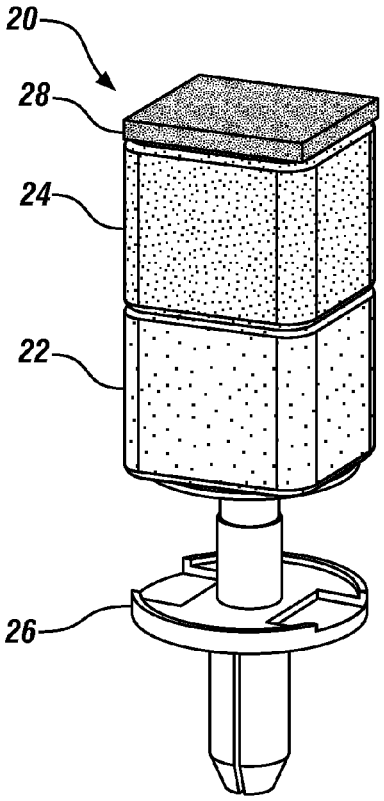
FIG. 4 shows a second embodiment of a bumper in which the frame attachment portion is a push-in fastener. The fastener has a head attached to a resilient polymer layer attached to an SMP layer capped with a thin layer of a resilient polymer.

A second bumper embodiment 20 is shown in FIG. 4. In this embodiment the stacking sequence is reversed so that the polymeric portion 22 is adjacent the attachment feature 26 and SMP portion 24 is placed atop polymeric portion 22. In operation, such a configuration may result in undesirably high impact loads when closure 110 is brought into contact with the bumper 20. To mitigate the impact load such a bumper may incorporate a second, thin, polymer layer or 'cap' 28 to reduce the initial load peak. Also shown in FIG. 4 is a mounting portion 26 comprising a push-in polymer attachment. The attachment is shown in an extended configuration suitable for installation. When installed the attachment is collapsed to lock the fastener in place and bring polymer portion 22 proximate its intended body or closure mounting surface.

Figure 5:
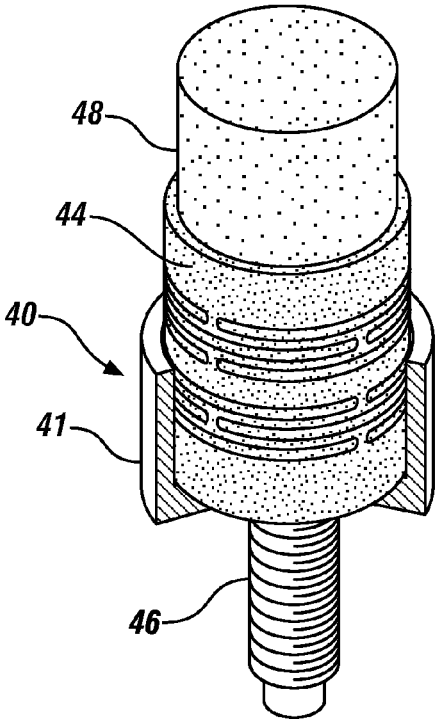
FIG. 5 shows a third embodiment of a bumper in which a cylindrically-shaped, block-like SMP portion incorporating slits and cut-outs is secured within a hollow cylindrical canister with a closed and an open end. The exterior surface of the closed end of the canister is secured to a screw fastener and the SMP portion is capped with a resilient polymer layer.
Figure 6:
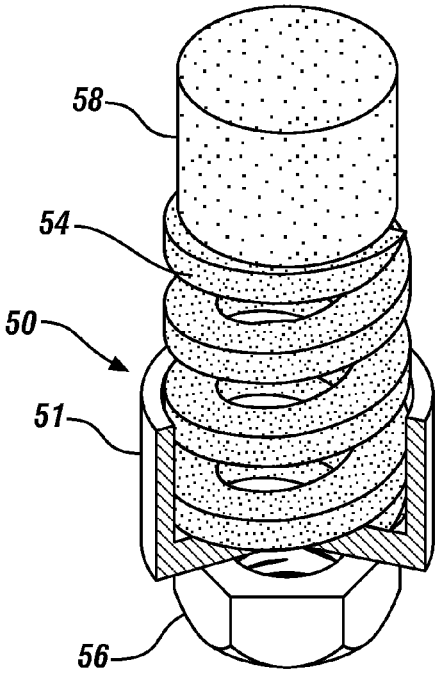
FIG. 6 shows a fourth embodiment of a bumper in which a spring-like SMP portion is secured within a hollow cylindrical canister with a closed and an open end. The exterior surface of the closed end of the canister is secured to a bolt fastener and the SMP portion is capped with a resilient polymer layer.

FIGS. 5 and 6 illustrate two other embodiments. Bumper 40, shown at FIG. 5 comprises a cylindrical SMP portion 44 with cutouts to modify its stiffness geometrically. With appropriate sizing and numbers of cut-outs the SMP may be shaped using lower initial applied loads during setting. Only after the SMP is compressed sufficiently to close up the slots will the applied force need to be increased to enforce further adjustment. To control possible lateral motion, buckling and/or bending of the SMP during compression, SMP portion 44 is loosely confined in an open ended container 41 secured to attachment feature 46, here depicted as a threaded screw shaft. SMP portion 44 supports a polymeric portion 48, here shown as having a modestly-reduced cross-section compared to SMP portion 44, for contact with the closure panel (not shown). Bumper 50, shown in FIG. 6, employs an SMP portion 54, generally in the form of a coil spring, again enabling an initial deflection under lower force until the spring 'bottoms out' and is again laterally constrained by loosely-fitting open-ended container 51 and supporting polymer portion 58. Here attachment feature 56 is shown as an internally threaded nut.

It may be noted that an alternative approach to geometrically-increasing the SMP compliance would be to incorporate a blowing agent into the SMP to render a porous SMP body with either open or closed pores. Where decreased compliance is desired, fillers, may be incorporated into the SMP. These may be fibers or powders and comprise electrically-conducting and thermally-conducting compositions such as metals or graphite, or electrically-insulating compositions such as ceramics or polymers or mixtures of both.

Figure 7A:
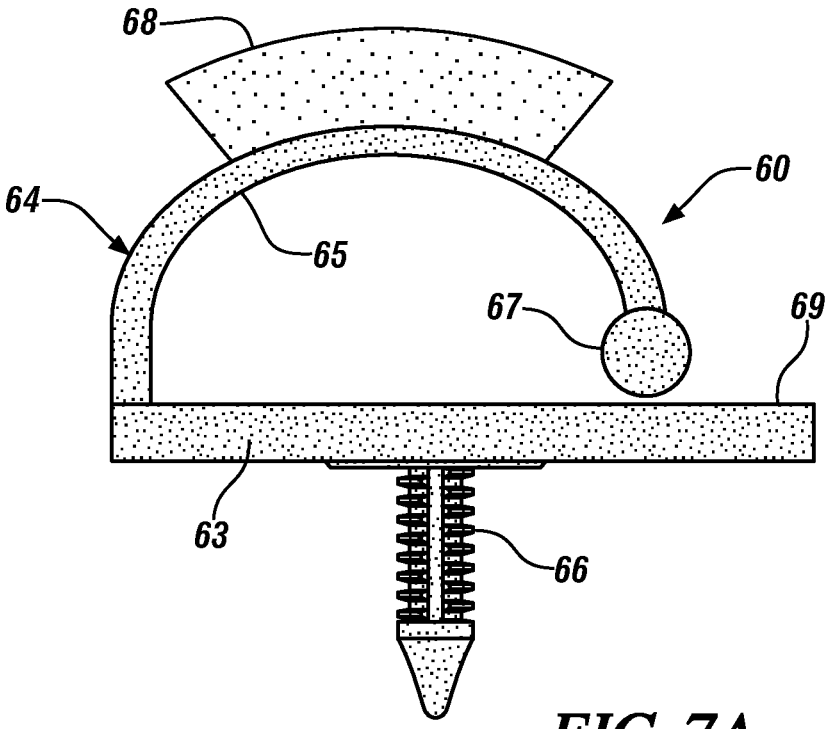
FIGS. 7A-B shows a fifth embodiment of a bumper.
Figure 7B:
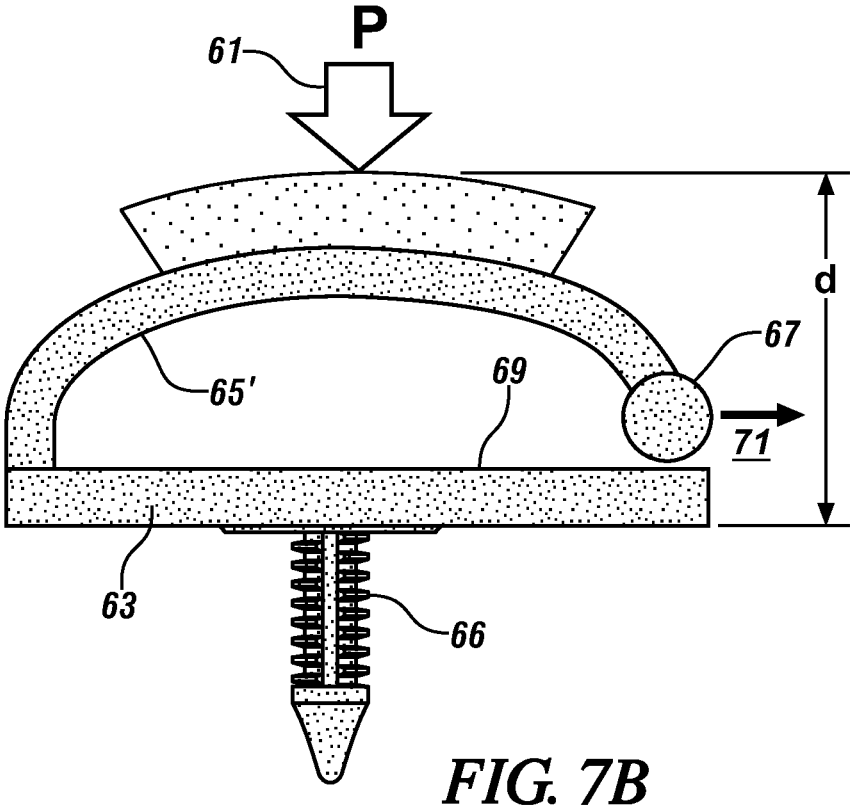

Another embodiment of a bumper is shown at FIGS. 7A and 7B. In FIG. 7A the bumper 60 is shown prior to installation and comprises a one piece SMP portion 64 comprising a base 63 connected to an arcuate portion 65 with a radius bending back over the base and terminating in a ball, or similar slidable feature 67. Ball 67 is proximate to or lightly contacts surface 69 of base 63 and arcuate portion 65 supports polymeric portion 68. Mounting portion 66 is here shown as a push-in plastic retainer with arms extending from a central shaft and intended to engage the edges of a complementary opening in a sheet metal panel (not shown). Mounting portions 66 are commonly known as Christmas Tree fasteners.

FIG. 7B shows the bumper of FIG. 7A after setting. On application of load P in the direction of arrow 61, the arcuate portion 65 (FIG. 7A) will be displaced downward, first bringing ball 67 into contact with surface 69 of base 63 and then displacing it laterally along base 63 in the direction of arrow 71 while simultaneously modifying the radius of the arcuate portion 65'. When the combined height of the SMP base portion 64' and SMP arcuate portion 65' is 'd' (as in FIG. 3(*d*)), the bumper is set and ready for use.

Practices of the invention have been described using illustrative examples which are not intended to limit the scope of the claimed invention.

The invention claimed is:

1. An adjustable bumper comprising a shape memory polymer (SMP) for maintaining an intended spacing between opposing surfaces of a vehicle body and a closure panel, the bumper being adapted for attachment to either of the vehicle body or the closure panel, the bumper comprising:

a mounting portion for attachment of the bumper to the body or closure panel;

a shape memory polymer (SMP) portion composed to exhibit a transition temperature and, when heated to a temperature greater than the transition temperature, to be deformable to a length predetermined to enforce the intended separation between the opposing vehicle body and closure panel surfaces; and an elastomer portion;

the mounting feature serving as a base and supporting the SMP portion and the elastomer portion, each of the mounting feature, the SMP portion and the polymer portion having a central longitudinal axis for receiving a load, each of the mounting feature, the elastomer portion and the SMP portion being secured to one another and arranged one atop the other, mutually centered with their longitudinal axes commonly aligned with the longitudinal axis of the mounting portion.

2. The adjustable bumper of claim 1 in which the elastomer portion is positioned opposite the mounting feature with a free surface for contact with either of the closure panel or the vehicle body surfaces.

3. The adjustable bumper of claim 1 in which the SMP portion is positioned opposite the mounting feature with a free surface for contact with either of the closure panel or the vehicle body surfaces.

4. The adjustable bumper of claim 3 further comprising a thin, polymer layer positioned on the free surface of the SMP portion for contact with either of the closure panel or the vehicle body surfaces, the thin polymer layer being selected to reduce the initial load peak on closing the closure panel.

5. The adjustable bumper of claim 1 in which the SMP portion has a transition temperature and the ratio of the compliance of the elastomer portion to the SMP portion is at least 2:1 at ambient temperature and no greater than 1:5 at the transition temperature.

6. The adjustable bumper of claim 1 in which the SMP portion has a transition temperature and the ratio of the compliance of the elastomer portion to the SMP portion is at least 2:1 at ambient temperature and no greater than 1:10 at the transition temperature.

7. The adjustable bumper of claim 1 in which the SMP portion has a transition temperature and the ratio of the compliance of the elastomer portion to the SMP portion is at least 2:1 at ambient temperature and no greater than 1:20 at the transition temperature.

8. The adjustable bumper of claim 1 in which the SMP portion has a transition temperature in the range of about 70° C.-125° C.

9. The adjustable bumper of claim 1 in which the SMP portion has a transition temperature in the range of about 95° C.-105° C.

10. The adjustable bumper of claim 1 in which the elastomer portion comprises EPDM rubber (ethylene propylene diene monomer) rubber.

11. The adjustable bumper of claim 1 in which the SMP portion comprises pores.

12. The adjustable bumper of claim 1 in which the SMP portion comprises fibers or particles.

13. The adjustable bumper of claim 1 in which the mounting portion comprises one of the group consisting of adhesive, a screw, a bolt, a push-in fastener, a tabbed plate and a weldable attachment.

14. A method of installing and setting an adjustable bumper adapted for attachment to either of a vehicle body or a closure panel, the bumper having an initial height, greater than a set height, and comprising a mounting feature attached to an end of shape memory polymer (SMP) portion with a height and a transition temperature, the SMP portion having an opposing end attached to an end of an elastomeric portion, the elastomeric portion having an opposing end for contacting a surface of a vehicle body or a surface of a closure panel to maintain a predetermined spacing between a surface of a vehicle body and an opposing surface of an opposed closure panel, the method comprising:

securing the mounting feature of the adjustable bumper to either of the vehicle body or closure panel without contacting the surface of the opposing closure panel or vehicle body with the opposing end of the polymer portion;

heating at least the SMP portion to its transition temperature; then forcibly rotating the closure panel in a direction suitable for bringing the surfaces of the vehicle body and closure panel to the predetermined spacing so that one or other of the vehicle body or closure panel surfaces is brought into contact with the opposing end of the elastomeric portion and, under continuing rotation, compressing the bumper to reduce its height to the set height by deforming at least the SMP portion of the bumper so that it adopts a deformed shape; then cooling at least the SMP portion of the bumper while maintaining the vehicle body and the closure panel in the predetermined position until the temperature of the SMP portion is less than its transition temperature to thereby render permanent the deformed shape of the SMP portion and the set height of the bumper.

15. The method of installing and setting an adjustable bumper of claim 14 in which at least the SMP portion of the bumper is heated in an oven or a heated bath before it is secured to either of the vehicle body or closure panel.

16. The method of installing and setting an adjustable bumper of claim 14 in which the closure panel is one of a hood, a decklid and a door.

17. The method of installing and setting an adjustable bumper of claim 14 in which the vehicle body and the closure panel are maintained in the predetermined position by a jig or fixture.

18. The method of installing and setting an adjustable bumper of claim 14, in which the initial height of the bumper is selected to at least contact the surface of the vehicle body or closure panel when the predetermined spacing between the surfaces of the vehicle body and the opposed closure panel is a largest spacing permitted within an allowable variation in the spacing between the opposing vehicle body and closure panel, and the SMP portion is sized to accommodate a reduction in height greater than or equal to an allowable tolerance range.

19. The method of installing and setting an adjustable bumper of claim 14 in which the allowable tolerance range is 6 millimeters.

* * * * *